US009414984B2

(12) United States Patent
Jaguan

(10) Patent No.: US 9,414,984 B2
(45) Date of Patent: Aug. 16, 2016

(54) SEXUAL AID

(71) Applicant: Mauro Jaguan, Caracas (VE)

(72) Inventor: Mauro Jaguan, Caracas (VE)

( * ) Notice: Subject to any disclaimer, the term of this patent is extended or adjusted under 35 U.S.C. 154(b) by 254 days.

(21) Appl. No.: 14/304,950

(22) Filed: Jun. 15, 2014

(65) Prior Publication Data

US 2015/0359696 A1 Dec. 17, 2015

(51) Int. Cl.

| | |
|---|---|
| ***A61G 99/00*** | (2006.01) |
| ***A47C 15/00*** | (2006.01) |
| ***A61H 1/00*** | (2006.01) |
| ***A61H 19/00*** | (2006.01) |

(52) U.S. Cl.

CPC ..... *A61G 99/00* (2013.01); *A47C 15/008* (2013.01); *A61H 1/00* (2013.01); *A61H 19/50* (2013.01)

(58) Field of Classification Search

CPC ..... A61G 99/00; A61G 7/015; A61G 13/02; A61G 13/08; A61G 15/005; A61G 15/02; A61G 15/08; A47C 15/00; A47C 15/008; A47C 9/00; A61H 19/00; A61H 19/50; A61H 1/00; A61H 1/001; A63B 17/00; A63B 21/00047; A63B 21/00178; A63B 21/00185; A63B 21/002; A63B 21/0023; A63B 21/068; A63B 21/078; A63B 21/28; A63B 21/285; A63B 21/4029; A63B 21/4031; A63B 22/06; A63B 69/10; A61B 5/70; A61B 5/704; A61B 6/04; A61B 6/0478; A61B 8/40

See application file for complete search history.

(56) References Cited

U.S. PATENT DOCUMENTS

| | | | | |
|---|---|---|---|---|
| 4,825,855 | A | 5/1989 | Kundson, Jr. | |
| 5,294,176 | A | 3/1994 | Asinovsky | |
| 5,385,154 | A * | 1/1995 | Fuhrman | A47C 15/008 128/845 |
| 5,875,779 | A * | 3/1999 | Fuhrman | A47C 15/008 128/845 |
| 5,971,480 | A | 10/1999 | Maschke | |
| 2003/0126686 | A1 * | 7/2003 | Nash | A47C 15/008 5/657 |
| 2003/0221692 | A1 | 12/2003 | Jones | |
| 2009/0084387 | A1 * | 4/2009 | Casteras Farre | A47C 15/008 128/845 |
| 2012/0006334 | A1 | 1/2012 | Cayabyab et al. | |

* cited by examiner

*Primary Examiner* — Alireza Nia
*Assistant Examiner* — Raymond E Harris
(74) *Attorney, Agent, or Firm* — William Lovin & Associates LLC; William Lovin

(57) ABSTRACT

The present invention relates to the field of sexual aids and more particularly to a machine that facilitates copulation by positioning the female participant so that her genitalia are more easily penetrated by her male partner when he copulates with her from the rear.

4 Claims, 3 Drawing Sheets

SEXUAL AID

CROSS-REFERENCE TO RELATED APPLICATIONS

This application takes benefit of U.S. Provisional App. 61/837,135 dated Jun. 19, 2013 which is incorporated herein in its entirety by reference.

FIELD OF THE INVENTION

The present disclosure deals with a mechanical device used to facilitate copulation between two human beings.

BACKGROUND OF THE INVENTION

The present invention relates to the field of sexual aids and more particularly to a machine that facilitates copulation by positioning the female participant so that her genitalia are more easily penetrated by her male partner when he copulates with her from the rear.

Numerous coupling positions have been introduced in various cultures and races from the familiar "missionary position" to other positions that imitate various animals—including horse, dogs, and such. While there are many other forms of sexual expression, the only method that results in the impregnation of a woman naturally is through the repeated penetration of the male organ into the female organ and the subsequent release of the sperm inside the female organ. This basic act has remained essentially the same throughout evolutionary history until now.

Numerous inventions have been posited to assist this basic act. For example, U.S. Pat. No. 5,971,480 is directed to a hanging seat, supported by means of a spring such that the seat spins, bobs, and swings. The seat is equipped with a hole through which the partners couple. A variety of motions may be experienced using this invention. For example, if the woman is rotated, the support rope is wound such that when released, the woman's body rotates in the reverse direction. Similarly, U.S. Pat. No. 5,875,779 is directed to a reciprocating human sexual fitness machine. The device comprises a pair of seats, one for the male partner and one for the female partner, and allows the female partner to reciprocate along an arcuate path with respect to the male partner as they copulate. Similarly, U.S. Pat. No. 5,385,154 provides for a two seat assembly that allows for a variety of motions, essentially in a horizontal plane, while the couple is engaged in sexual intercourse. Similarly, U.S. Pat. No. 5,294,176 is directed to a rocking/swiveling chair for handicapped men who do not have full mobility of the lower portions of their trunks. The combination of rocking and swiveling motions makes it possible for the man, using his arms, to cause his partner to move rotationally and/or back-and-forth as they copulate. The device is intended to put the disabled male partner largely in control of the act. Similarly, U.S. Pat. No. 4,825,855 is directed to an intercourse aiding apparatus utilizing a circular frame suspended above a bed and supported by cables. From this circular frame, a cloth panel is draped in the form of a sling wherein the cloth panel has an opening through which the partners couple. The invention allows the seated partner to rock and spin. Similarly, U.S. Pat. App. No. 2012/0006334 is directed to a horizontally mounted, rotatable cylindrical framework in which the female partner lies. After penetration, the male partner is then free to rotate the female's body so as to spin the woman about his sex organ. Similarly, U.S. Pat. App. No. 2003/0221692 is directed to a circular turntable with a hole in the middle through which the participants couple. This device allows one participant to rotate while the other partner stays motionless.

The common thread throughout all these inventions is that they are not optimized for sexual intercourse in positions imitating those of animals, particularly those in which the male partner positions himself behind the female partner and penetrates her from the rear. While several of the above inventions incidentally allow the participants to be positioned in this configuration, none are optimized facilitating intercourse in this position. What is needed then is a device for facilitating sexual intercourse wherein the male participant copulates with the female participant from the rear.

BRIEF SUMMARY OF THE INVENTION

The present device provides an adjustable base with two vertical elements. The front vertical element is equipped with a horizontal thoracic support surface extending rearward and handlebars extending forward. The horizontal thoracic support is equipped with a pair of strap mounted stirrups each hanging from the rear edge of the thoracic support surface. The rear vertical element is equipped with a pair of horizontal buttocks supports with a strap mounted stirrup hanging from the front of each support. The buttocks supports are mounted such the distance between them may be varied, i.e. they may be adjusted so that they lie next to one another, or apart by several inches. The adjustable base is adjustable in length—thus varying the distance between the front vertical element and rear vertical element and the front vertical element and rear vertical element are independently adjustable in height.

The invention is used in the following manner. First, the female sits on the horizontal buttocks supports atop the rear vertical element. Ordinarily, the horizontal buttocks supports are placed at some distance from each other so as to expose and facilitate access to the female's genitalia. Next, the female places her feet in the stirrups attached to the buttocks supports. This flexes the knees and further separates the buttocks. Next, the female bends at the hips and places her thorax on the horizontal thoracic support. Ordinarily, the height of the front vertical element is adjusted such that the horizontal thoracic support is placed at or above the level of the buttocks supports and the female is comfortably flexed at the hips. Next, the female grasps the handlebars and copulation begins.

While intended primarily as an aid to copulation wherein the male penetrates the female from the rear, the device may be reconfigured to support other modes of copulation. For example, if the horizontal buttocks supports are placed next to each other and simultaneously lowered to the level of the horizontal thoracic support while the length of the adjustable base is adjusted such that the horizontal thoracic support and the horizontal buttocks supports are adjacent and co-planar, the woman may lie on her back and place her feet in the stirrups for intercourse in the missionary position. Numerous other positions are conceivable and limited only by the imagination.

DETAILED DESCRIPTION OF THE INVENTION

Figure 1:
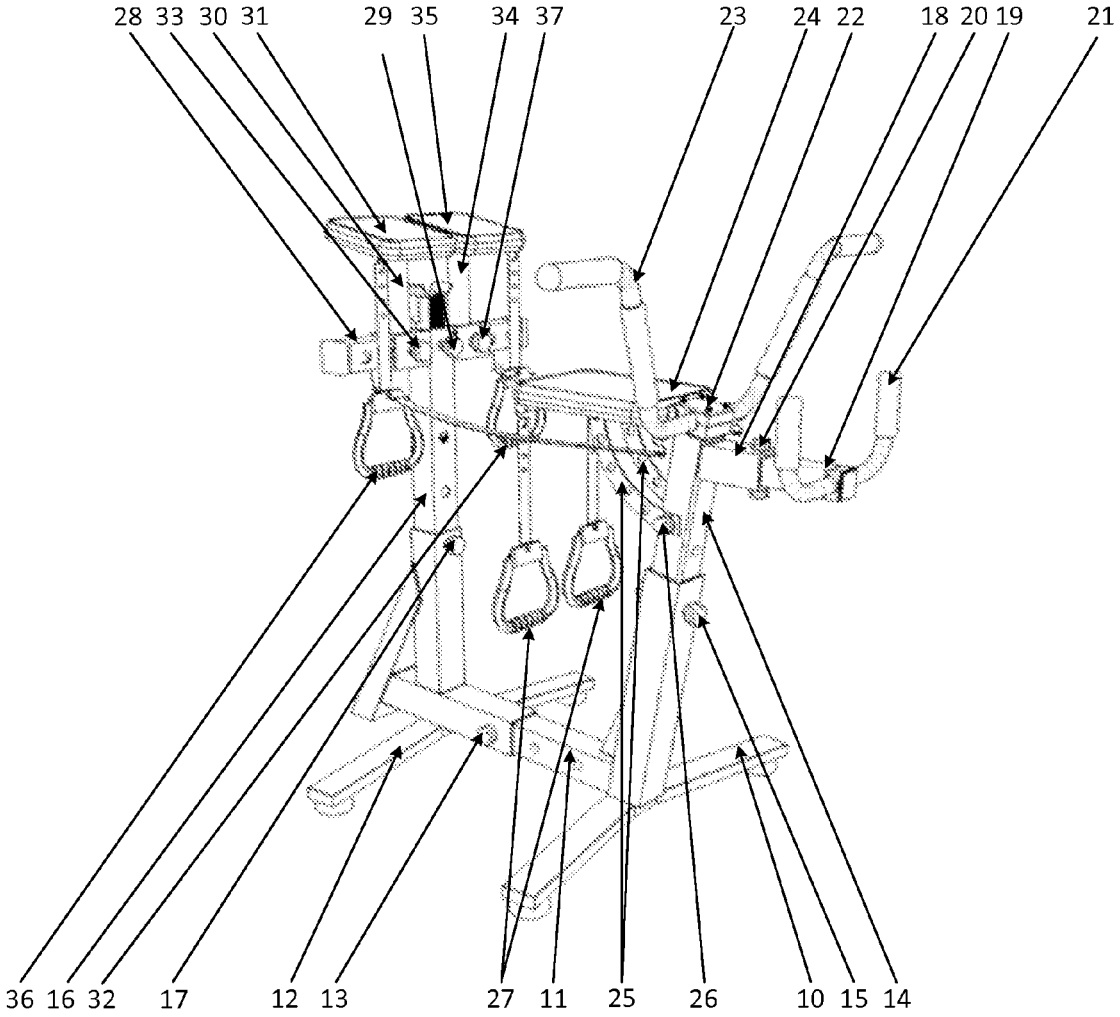
FIG. 1 is a three-quarter view of the right front of the sexual aid.
Figure 2:
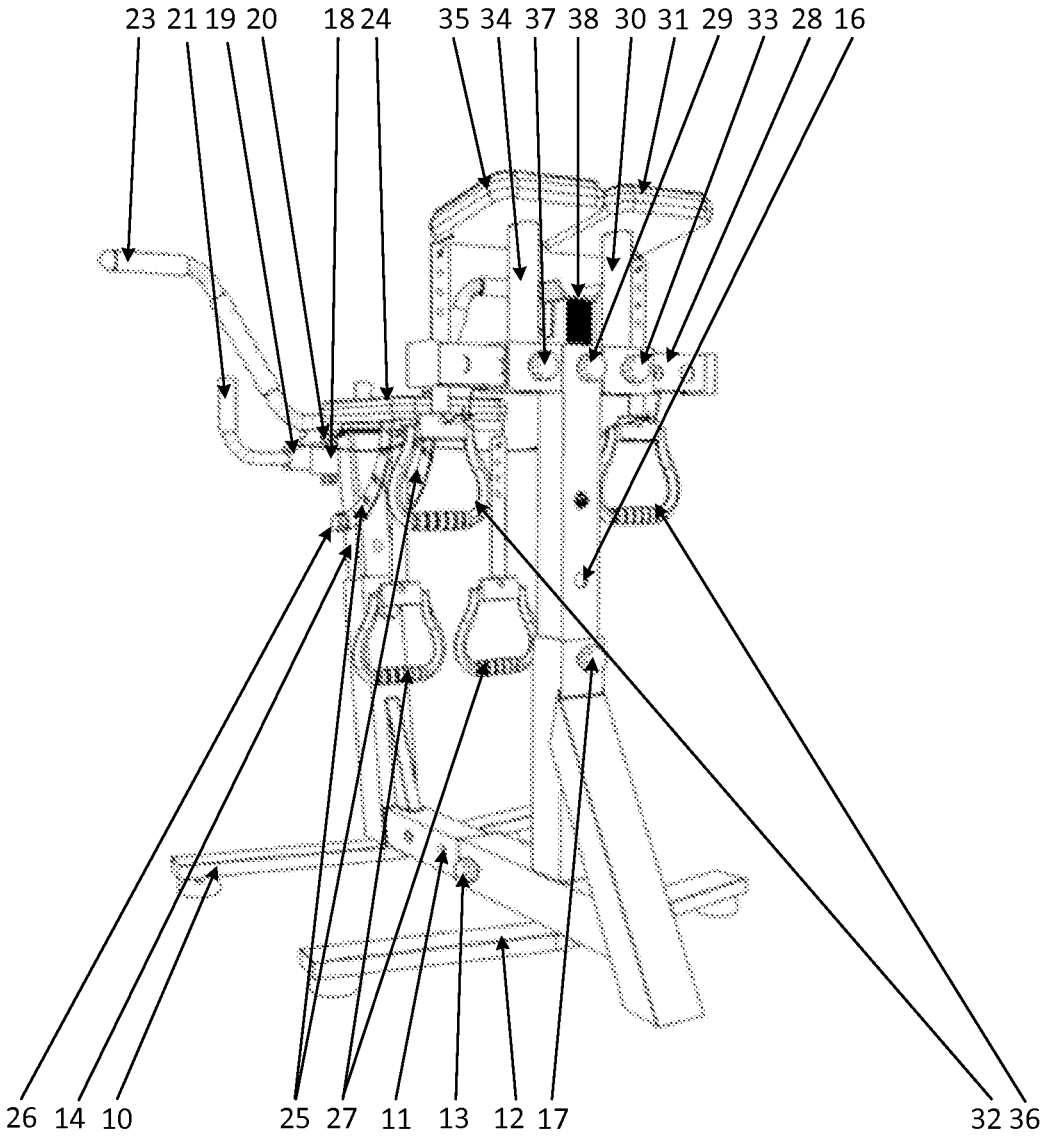
FIG. 2 is a three-quarter view of the left rear of the sexual aid.
Figure 3:
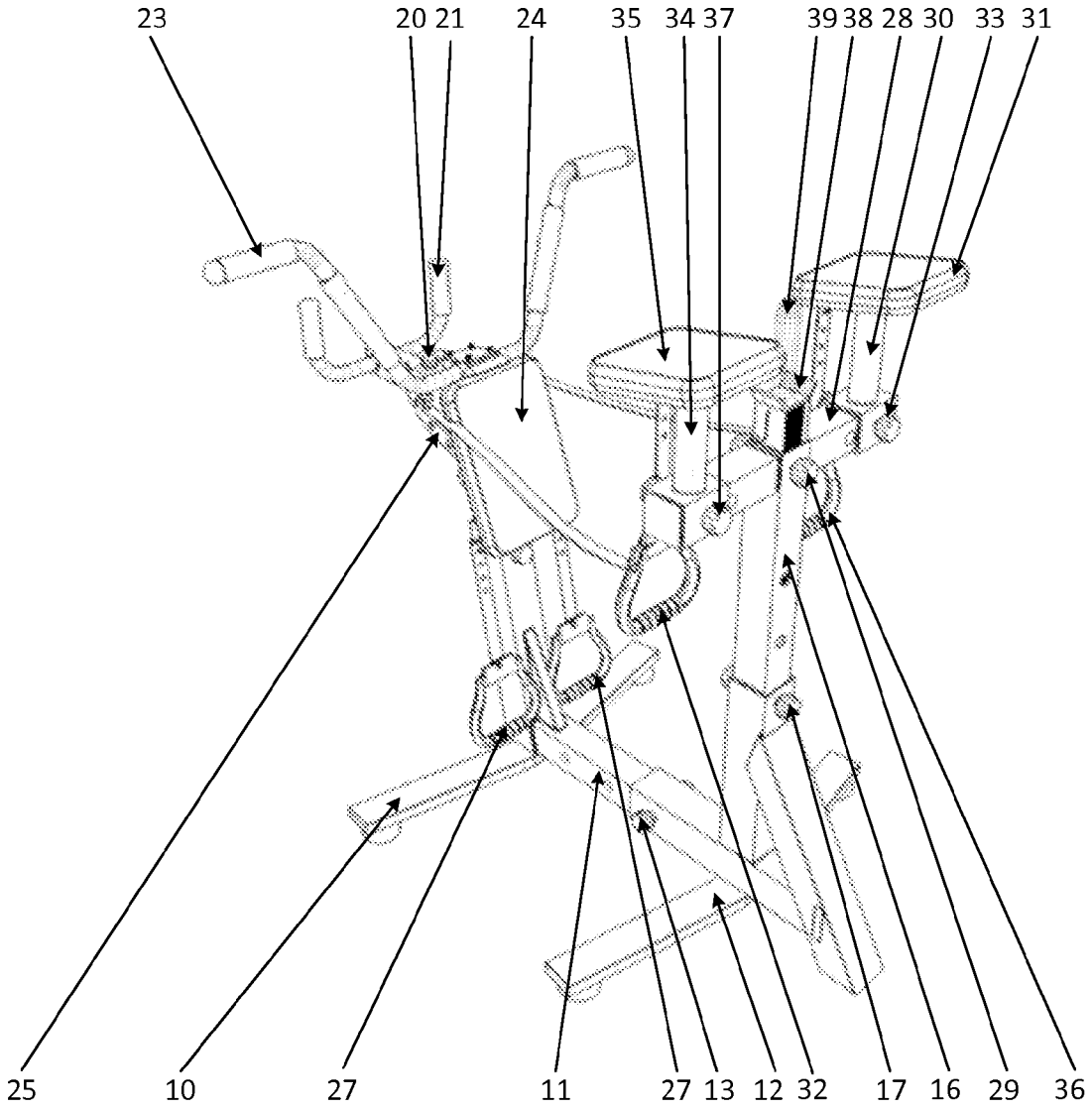
FIG. 3 is an alternative three-quarter view of the left rear of the sexual aid with an optional vibrator attached.

Referring now to FIGS. 1, 2, and 3 the preferred embodiment of a sexual aid of the present invention is illustrated. The device has a base comprising front base 10, adjustable base bar 11 and rear base 12. Adjustable base bar 11 is slidably displaceable with respect to rear base 12 to lengthen or shorten entire base. After choosing a desired length for the base, locking pin 13 is placed through concentric holes in rear base 12 and adjustable base bar 11. Front base 10 is comprised of a front vertical element substantially perpendicularly disposed to a transverse support bar with elastomeric feet at each end. Similarly, rear base 12 is comprised of a rear vertical element substantially perpendicularly disposed to a transverse support bar with elastomeric feet at each end. Inserted into, and slidably displaceable with respect to, the front vertical element of front base 10 is front support bar 14. After choosing a desired length for front support bar 14, locking pin 15 is placed through concentric holes in the front vertical element of front base 10 and front support bar 14 locking them together at a convenient height. Similarly, after choosing a desired length for rear support bar 16, locking pin 17 is placed through concentric holes in the rear vertical element of rear base 12 and rear support bar 16 locking them together at a convenient height.

Affixed to the front of front support bar 14 and proceeding generally orthogonally from the front of front support bar 14 is handlebar support 18. Inserted into, and slidably displaceable with respect to, handlebar support 18 is handlebar extension 19. Affixed in turn to the distal end of handlebar extension 19 is a front handlebar 21 with two front handles. After choosing a desired length for handlebar extension 19, locking pin 20 is placed through concentric holes in handlebar support 18 and handlebar extension 19 locking them together at a convenient length. Affixed to the top of front support bar 14 is rear handlebar 23. Rear handlebar 23 is affixed to the top of front support bar 14 by means of bracket hinge 22. By loosening bracket hinge 22, the angle of rear handlebar 23 may be varied. Affixed to the hinged end of bracket hinge 22 is horizontal thoracic support 24. Horizontal thoracic support 24 is ordinarily covered with a padded material for comfort. Attached to the rearward-most aspect of horizontal thoracic support 24 are two support arms 25. The angle of horizontal thoracic support 24 may be adjusted up and down and when the desired angle is achieved locking pin 26 is placed through concentric holes in front support bar 14 and support arms 25 fixing horizontal thoracic support 24 at a convenient angle. Attached to the rear aspect of horizontal thoracic support 24 and on either side are adjustable front stirrups 27.

Affixed transversely to rear support bar 16 and proceeding generally orthogonally from the left and right sides of rear support bar 16 is seat support bar 28. Seat support bar 28 is perforated in the center such that it may be placed over, and slidably displaced up and down with respect to, rear support bar 16. After choosing a desired height for seat support bar 28 locking pin 29 is placed through concentric holes in seat support bar 28 and rear support bar 16 locking them together at a convenient height. Placed over, and slidably displaceable with respect to, seat support bar 28 are left and right seat supports 34 and 30. Affixed to the top of left and right seat supports 34 and 30 are left and right horizontal buttocks supports 35 and 31, respectively. Left and right seat supports 34 and 30 may be placed at any distance along the length of seat support bar 28, thus allowing the user to separate left and right horizontal buttocks supports 35 and 31 and place them at any desired distance from one another. After placing them at the desired location, locking pins 37 and 33 are placed through concentric holes in seat support bar 28 and left and right seat supports 34 and 30, respectively, to fix them in place. Affixed to the bottom, front of left and right horizontal buttocks supports 35 and 31, respectively, are left and right rear stirrups 32 and 36, respectively. Affixed to the top of rear support bar 16 is flexing mounting surface 38. Various vibrators 39 and other clitoral/vaginal stimulators may be affixed to flexing mounting surface 38.

The invention is used in the following manner: First, it is necessary to position front support bar 14 and rear support bar 16 at an appropriate height. This will vary based on personal preference and physical stature. After locking front support bar 14 and rear support bar 16 at the selected height with respect to front base 10 and rear base 12, respectively, by means of locking pins 15 and 29, respectively, left and right seat supports 34 and 30, respectively are adjusted laterally along seat support bar 28. The distance between left and right seat supports 34 and 30 and attached left and right horizontal buttocks supports 35 and 31, respectively, from one another is also a matter of personal preference and physical stature. Ordinarily, left and right horizontal buttocks supports 35 and 31, respectively, are placed at some distance from one another so as to expose and facilitate access to the female's genitalia from the rear. After locking left and right horizontal buttocks supports 35 and 31, respectively, to seat support bar 28 by inserting locking pins 37 and 33 through concentric holes in seat support bar 28 and left and right seat supports 34 and 30, the user may attach, if desired, vibrator 39 or some other clitoral/vaginal stimulator to the top of flexing mounting surface 38. Next, it is necessary to position horizontal thoracic support 24 at an appropriate height and angle. This too will vary based on personal preference and physical stature, and should be set such that when the female is seated on left and right horizontal buttock supports 35 and 31 and flexes forward at hips her thoracic area is comfortably supported on horizontal thoracic support 24. The angle of horizontal thoracic support 24 can be varied by removing locking pin 26 and pivoting horizontal thoracic support 24 down to a desired location and reinserting locking pin 26 through concentric holes located in support arms 25 and front support bar 14. Ordinarily, however, adjustments to the height of front support bar 14 and horizontal thoracic support 24 will be made in tandem to effectuate a comfortable position. Typically however, the height front support bar 14 is adjusted such that horizontal thoracic support 24 is placed at or above the level of left and right horizontal buttocks supports 35 and 31, respectively, such that when seated the female is comfortably flexed forward at the hips. Next the female sits on left and right horizontal buttocks support 35 and 31 facing generally in the direction of front support bar 14. If a vibrator 39 or other clitoral/vaginal stimulator was attached to the top of flexing mounting surface 38, the female adjusts her buttocks and genital area such that vibrator 39 makes contact with her clitoris and/or vulva. Next, the female places her left and right feet in left and right rear stirrups 32 and 36, respectively, attached to the front of left and right horizontal buttocks supports 35 and 31, respectively. This flexes the knees and further separates the buttocks. Next, the female bends at the hips and places her thorax on horizontal thoracic support 24. If a vibrator 39 or other clitoral/vaginal stimulator was attached to the top of flexing mounting surface 38, it flexes and is positioned firmly against the female's clitoris and/or vulvar area. Finally, the female grasps rear handlebars 23 and copulation begins.

While intended primarily as an aid to copulation wherein the male penetrates the female from the rear, the device may be reconfigured to support numerous other positions and other modes of copulation. For example, if left and right horizontal buttocks supports 35 and 31, respectively, are placed next to each other and simultaneously lowered to the level of horizontal thoracic support 24 while the length of the adjustable base is adjusted such that horizontal thoracic support 24 and left and right horizontal buttocks supports 35 and 31, respectively, are adjacent and co-planar, the woman may lie on her back with knees flexed and with her feet in the adjustable front stirrups 27 for intercourse in the missionary position.

Similarly, if left and right horizontal buttocks supports 35 and 31, respectively, are placed next to each other raised substantially above the level of horizontal thoracic support 24 while the length of the adjustable base is adjusted such that horizontal thoracic support 24 and left and right horizontal buttocks supports 35 and 31, respectively, are as far apart as possible, the female may place her feet in suitably adjustable front stirrups 27 while simultaneously bending at the waist and bearing the weight of her torso on her horizontal thoracic support 24 and grasping front handlebar 21. Simultaneously, the male places his left and right feet in left and right rear stirrups 32 and 36, respectively, attached to the front of left and right of horizontal buttocks supports 35 and 31, respectively, and then places his buttocks on left and right horizontal buttocks supports 35 and 31 while grasping rear handlebar 23 with his hands. In this position his sex organ closely approximates the female's vulvar area and copulation can occur.

It will be readily apparent that numerous other positions and modes of use are conceivable and limited only by the imagination. In the interest of brevity and in the interest of not detracting from the essential characteristics of the invention, however, a description of these positions and modes of use are omitted. Nevertheless such positions and modes of use are explicitly included in the spirit and scope of the present specification.

What is claimed is:

1. A sexual aid with a base comprising:

a) a front base further comprising a front vertical element substantially perpendicularly disposed to a transverse support bar, and slidably affixed to a substantially vertical, height-wise adjustable front support bar further comprising:

i. a forward projecting, lengthwise adjustable front handlebar assembly;

ii. a substantially vertical, angularly adjustable rear handlebar assembly;

iii. a rearward projecting, angularly adjustable horizontal thoracic support;

b) a rear base further comprising a rear vertical element substantially perpendicularly disposed to a transverse support bar, and slidably affixed to a substantially vertical, height-wise adjustable rear support bar further comprising:

i. a transversely oriented seat support bar that is slidably displaceable up and down said rear support bar and affixable to it;

ii. two substantially vertical seat supports each of which is slidably displaceable with respect to said seat support bar and affixable to it;

iii. two horizontal buttock supports, perpendicularly affixed to said vertical seat supports; and c) a length-wise adjustable base bar affixed to said front base and slidably displaceable and affixable to said rear base.

2. The sexual aid of claim 1 further comprising more than one lengthwise adjustable hanging stirrup attached to a rear aspect of said rearward projecting, angularly adjustable horizontal thoracic support.

3. A sexual aid of claim 1 further comprising at least one lengthwise adjustable hanging stirrup attached to a forward aspect of each horizontal buttock support.

4. A sexual aid of claim 1 wherein each of said transverse support bars further comprises more than one foot.

* * * * *